US012193570B2

(12) United States Patent
LeBlanc

(10) Patent No.: US 12,193,570 B2
(45) **Date of Patent: *Jan. 14, 2025**

(54) FLAT PACK SHELF AND BRACKET SYSTEM

(71) Applicant: Lewis Hyman, Inc., Carson, CA (US)

(72) Inventor: Robert LeBlanc, Kennesaw, GA (US)

(73) Assignee: Lewis Hyman, Inc., Carson, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/952,524

(22) Filed: Sep. 26, 2022

(65) Prior Publication Data

US 2023/0100551 A1 Mar. 30, 2023

Related U.S. Application Data

(60) Provisional application No. 63/248,277, filed on Sep. 24, 2021.

(51) Int. Cl.
*A47B 96/02* (2006.01)
*A47B 96/06* (2006.01)

(52) U.S. Cl.
CPC ..... *A47B 96/028* (2013.01); *A47B 96/061* (2013.01); *A47B 2220/0036* (2013.01)

(58) Field of Classification Search
CPC ..... A47B 96/028; A47B 96/061; A47B 2220/0036
USPC ..... 108/108
See application file for complete search history.

(56) References Cited

U.S. PATENT DOCUMENTS

| | | | |
|---|---|---|---|
| 830,943 | A | 9/1906 | Herman |
| 1,599,653 | A | 9/1926 | Cranston |
| 1,892,687 | A | 3/1933 | Teufel |
| 3,143,980 | A | 8/1964 | Sperring |
| 3,284,040 | A | 11/1966 | Marontate |
| 3,463,433 | A | 8/1969 | Stein et al. |

(Continued)

FOREIGN PATENT DOCUMENTS

| | | |
|---|---|---|
| CN | 1310591 | 8/2001 |
| CN | 102078093 | 6/2011 |

(Continued)

OTHER PUBLICATIONS

Notice of Allowance, dated Feb. 3, 2023, from corresponding U.S. Appl. No. 17/473,638.

(Continued)

*Primary Examiner* — Janet M Wilkens
(74) *Attorney, Agent, or Firm* — Thomas | Horstemeyer, LLP

(57) ABSTRACT

The present disclosure provides a shelf and bracket system that comprises a shelf and a bracket assembly. In various embodiments, the bracket assembly comprises a main bracket bar, a plurality of support arms, and hardware for attaching each of the plurality of support arms to the main bracket bar. In addition, in various embodiments, each support arm is disposed adjacent a respective end of the main bracket bar and the respective first hardware for the support arm is configured such that, when disengaged, the support arm is configured to rotate between a shelf support position and a folded storage position so that when each of the plurality of support arms are in the folded storage position, the bracket assembly is substantially flat.

20 Claims, 6 Drawing Sheets

(56) References Cited

U.S. PATENT DOCUMENTS

| | | | | |
|---|---|---|---|---|
| 4,071,216 | A * | 1/1978 | Einhorn | A47B 96/061 248/282.1 |
| 4,934,645 | A | 6/1990 | Breslow | |
| D341,819 | S | 11/1993 | Carlstrom | |
| 5,316,253 | A | 5/1994 | Flathau et al. | |
| 5,452,875 | A | 9/1995 | Kern | |
| 5,775,655 | A * | 7/1998 | Schmeets | A47B 5/00 108/115 |
| 6,098,566 | A | 8/2000 | Metcalf | |
| 6,164,610 | A | 12/2000 | Santiago | |
| 7,178,775 | B2 | 2/2007 | Pfister et al. | |
| 9,594,933 | B2 | 3/2017 | Kuniavsky et al. | |
| 9,861,198 | B2 | 1/2018 | Anderson | |
| 10,575,641 | B1 | 3/2020 | Severa | |
| 11,116,317 | B2 * | 9/2021 | LeBlanc | A47B 96/067 |
| 11,272,795 | B2 | 3/2022 | Landgren | |
| 11,641,942 | B1 | 5/2023 | Rockley | |
| 11,825,946 | B1 * | 11/2023 | Anderson | A47B 96/028 |
| 2009/0224119 | A1 | 9/2009 | Heffernan | |
| 2017/0023174 | A1 | 1/2017 | Harmon | |
| 2020/0146450 | A1 * | 5/2020 | LeBlanc | A47B 96/1441 |
| 2022/0395097 | A1 | 12/2022 | Horezga | |
| 2023/0129858 | A1 * | 4/2023 | Anderson | A47B 96/028 211/90.01 |
| 2023/0248148 | A1 * | 8/2023 | LeBlanc | A47B 96/061 108/157.17 |

FOREIGN PATENT DOCUMENTS

| | | |
|---|---|---|
| CN | 201870125 U | 6/2011 |
| CN | 104510179 | 4/2015 |
| EP | 3005904 | 4/2016 |
| GB | 2214414 | 9/1989 |
| GB | 2293963 | 4/1996 |
| JP | 2016083244 | 5/2016 |

OTHER PUBLICATIONS

Amazon.com, Homewell Wood Floating Shelves for Home Decoration, Grey: Furniture & Decor, earliest review Jan. 30, 2018, 10 pages.

Notice of Allowance, dated May 27, 2021, from corresponding U.S. Appl. No. 16/677,206.

Office Action, dated Nov. 20, 2020, from corresponding U.S. Appl. No. 16/677,206.

Office Action, dated Sep. 8, 2022, from corresponding U.S. Appl. No. 17/473,638.

Office Action, dated Jan. 17, 2024, from corresponding U.S. Appl. No. 18/329,123.

Office Action, dated Mar. 20, 2024, from corresponding U.S. Appl. No. 18/134,357.

* cited by examiner

FLAT PACK SHELF AND BRACKET SYSTEM

CROSS-REFERENCE TO RELATED APPLICATION

This application claims the benefit of priority to U.S. Provisional Patent Application No. 63/248,277, filed Sep. 24, 2021, which is hereby incorporated by reference in its entirety for all purposes.

FIELD OF THE INVENTION

The present disclosure is generally related to a shelf and bracket system, as well as processes for installing the shelf and bracket system.

BACKGROUND

A traditional process for hanging a shelf involves: (1) acquiring two separate support arms and a shelf; (2) mounting the arms on a wall so that the arms are horizontally offset from one another, and so that the upper surfaces of the arms are at the same height on the wall; and (3) installing the shelf so that it is in a horizontal position and supported by the upper support surfaces of the respective offset support arms. One problem with this process is that it can be difficult for users to install the support arms so that the support arms are at least approximately the same height (which is generally required for the shelf to lay horizontally level across the support arms).

SUMMARY

General aspects of the present disclosure are related to a shelf and bracket system. In various embodiments, the shelf and bracket system comprises a shelf and a bracket assembly. In particular embodiments, the bracket assembly comprises a main bracket bar, a plurality of support arms, first hardware for attaching each of the plurality of support arms to the main bracket bar, second hardware for attaching the shelf to each of the plurality of support arms, and third hardware for attaching the main bracket bar to a vertical support surface. In some embodiments, each support arm is disposed adjacent a respective end of the main bracket bar and the respective first hardware for the support arm is configured such that, when disengaged, the support arm is configured to rotate between a shelf support position and a folded storage position so that when each of the plurality of support arms are in the folded storage position, the bracket assembly is substantially flat.

In some embodiments, each of the plurality of support arms is configured to direct at least a portion of a weight of the shelf into the vertical support surface when the plurality of support arms are in the shelf support position. In some embodiments, each of the plurality of support arms is configured to put weight onto the main bracket bar while minimizing shear force on the first hardware when the plurality of support arms are in the shelf support position. In some embodiments, each of the plurality of support arms comprises a substantially U-shaped portion that conforms to a shape of an indented length of the main bracket bar.

In some embodiments, each of the plurality of support arms comprises a recess at the respective end of the support arm to maintain the support arm in a substantially perpendicular orientation relative to the main bracket bar when the first hardware is engaged with one or more outside surfaces of the main bracket bar to attach the support arm to the main bracket bar. In some embodiments, the plurality of support arms are interchangeable to accommodate at least one of different sizes or different shapes of the shelf. In some embodiments, the plurality of support arms are sized to accommodate at least one of different sizes or different shapes of the shelf.

In some embodiments, the main bracket bar comprises an elongated cutout for each of the plurality of support arms to allow for an adjustment of spacing between the plurality of support arms by sliding a respective support arm laterally closer or farther away from at least one other of the plurality of support arms. In some embodiments, the main bracket bar comprises one or more recesses along a length of the main bracket bar, and the shelf comprises one or more slide-ins configured for sliding into the one or more recesses to attach the shelf to the main bracket bar without use of hardware.

In some embodiments, the bracket assembly comprises a level positioned on an upper surface of the main bracket bar to allow for installation of the main bracket bar in a substantially level orientation. In some embodiments, the level is positioned on the upper surface of the main bracket bar so that the level is hidden from view when the shelf is installed on the plurality of support arms and the bracket assembly is attached to the vertical support surface.

General aspects of the present disclosure are related to a shelf and bracket system that comprises a shelf and a bracket assembly. In particular embodiments, the bracket assembly comprises a main bracket bar, a plurality of support arms, and hardware for attaching each of the plurality of support arms to the main bracket bar. In some embodiments, each support arm is disposed adjacent a respective end of the main bracket bar and the respective first hardware for the support arm is configured such that, when disengaged, the support arm is configured to rotate between a shelf support position and a folded storage position so that when each of the plurality of support arms are in the folded storage position, the bracket assembly is substantially flat.

In some embodiments, each of the plurality of support arms comprises a substantially U-shaped portion that conforms to a shape of an indented length of the main bracket bar. In some embodiments, each of the plurality of support arms comprises a recess at the respective end of the support arm to maintain the support arm in a substantially perpendicular orientation relative to the main bracket bar when the hardware is engaged with one or more outside surfaces of the main bracket bar to attach the support arm to the main bracket bar. In some embodiments, the plurality of support arms are interchangeable to accommodate at least one of different sizes or different shapes of the shelf.

In some embodiments, the main bracket bar comprises an elongated cutout for each of the plurality of support arms to allow for an adjustment of spacing between the plurality of support arms by sliding a respective support arm laterally closer or farther away from at least one other of the plurality of support arms. In some embodiments, the main bracket bar comprises one or more recesses along a length of the main bracket bar, and the shelf comprises one or more slide-ins configured for sliding into the one or more recesses to attach the shelf to the main bracket bar without use of hardware.

General aspects of the present disclosure are related to a method for providing a shelf and bracket system a shelf, and a bracket assembly. In particular embodiments, the bracket assembly comprises a main bracket bar, a plurality of support arms, and hardware for attaching each of the plurality of support arms to the main bracket bar. In some embodiments, each support arm is disposed adjacent a respective end of the main bracket bar and the respective first hardware for the support arm is configured such that, when disengaged, the support arm is configured to rotate between a shelf support position and a folded storage position so that when each of the plurality of support arms are in the folded storage position, the bracket assembly is substantially flat. In some embodiments, the method further comprises: assembling the shelf and bracket system by rotating each support arm of the plurality of support arms to the shelf support position; engaging the hardware to attach each of the plurality of support arms to the main bracket bar, and attaching each of the plurality of support arms to the shelf.

BRIEF DESCRIPTION OF THE DRAWINGS

In the course of this description, reference will be made to the accompanying drawings, which are not necessarily drawn to scale, and wherein.

DETAILED DESCRIPTION

Figure 1B:
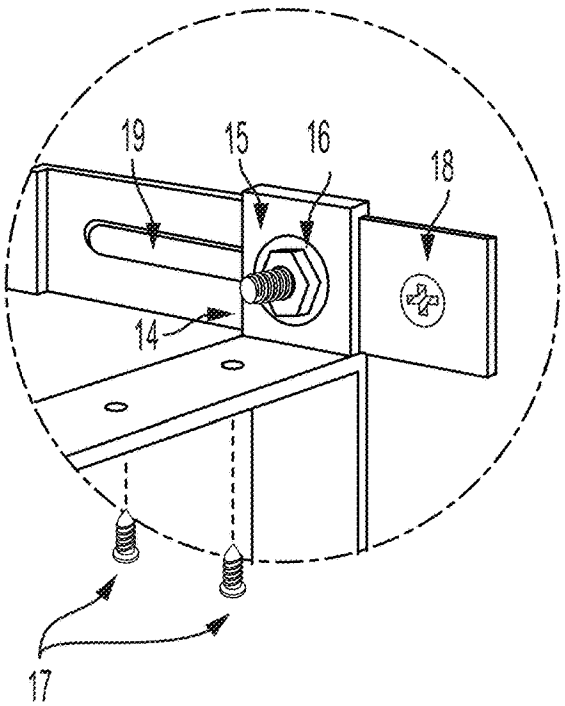
FIG. 1B is a diagram illustrating a detail view of the shelf and bracket system shown in FIG. 1A.

While this disclosure is illustrative of embodiments in many different forms, there are shown in the drawings, and will herein be described in detail, example embodiments of the disclosure with the understanding that the present disclosure is to be considered as illustrative of the principles of the disclosure, but is not intended to limit the broad aspect of the disclosure to the embodiments illustrated. In the following description of various example structures according to the disclosure, reference is made to the accompanying drawings, which form a part hereof, and in which are shown by way of illustration various example devices, systems, and environments in which aspects of the disclosure may be practiced. It is to be understood that other specific arrangements of parts, example devices, systems, and environments may be utilized, and structural and functional modifications may be made without departing from the scope of the present disclosure.

In addition, it is to be understood that the phraseology and terminology employed herein are for the purpose of description and should not be regarded as limiting. For example, the use of a singular term, such as, "a" is not intended as limiting of the number of items. Also the use of relational terms, such as but not limited to, "top," "bottom," "left," "right," "upper," "lower," "down," "up," "side," are used in the description for clarity and are not intended to limit the scope of the disclosure. Further, it should be understood that any one of the features can be used separately or in combination with other features. Other systems, methods, aspects, features, and advantages of the disclosure will be or become apparent to one with skill in the art upon examination of the detailed description. It is intended that all such additional systems, methods, aspects, features, and advantages be included within this description, be within the scope of the present disclosure, and be protected by the accompanying claims.

Figure 1A:
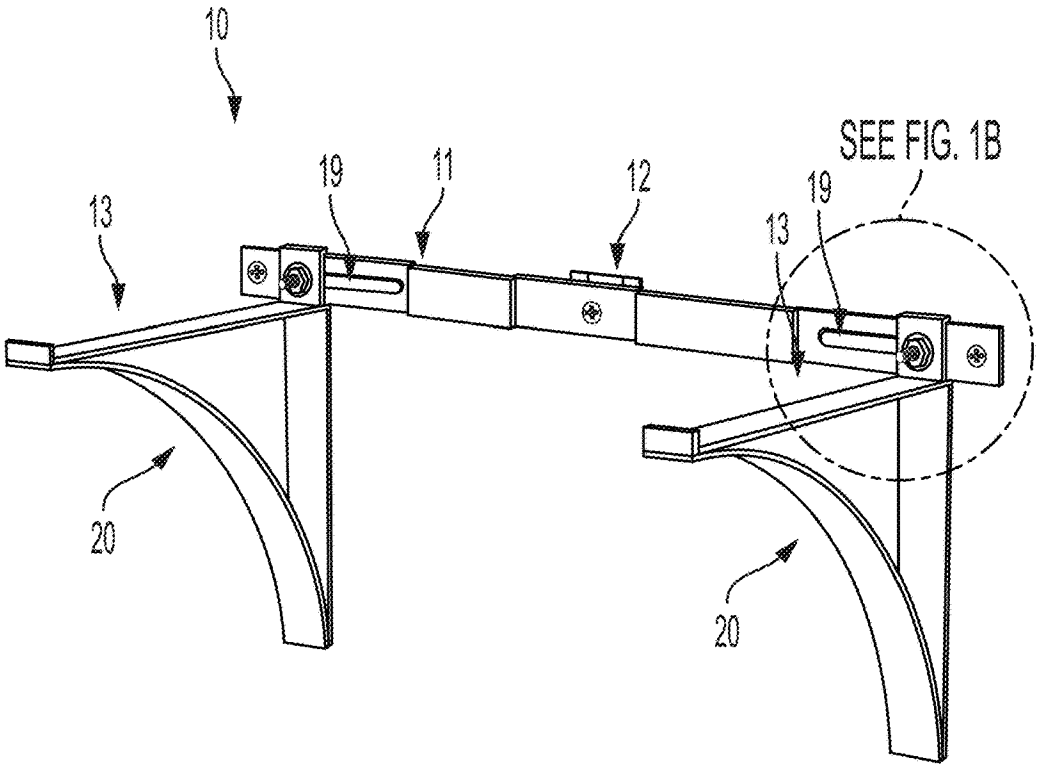
FIG. 1A is a diagram illustrating an example of a shelf and bracket system according to various embodiments of the present disclosure.

Various embodiments described herein provide an improved shelf and bracket system in which the system includes: (1) a bracket assembly; and (2) a shelf. Referring to FIGS. 1A and 1B, an example of a bracket assembly 10 is provided in which the components of the bracket assembly 10 comprise: (1) a main bracket bar 11 with an integrated level 12; (2) two support arms 13; (3) suitable hardware such as, for example, a bolt 14, nut 15, and washer 16, for attaching each of the support arms 13 to the main bracket bar 11; (4) suitable hardware 17 for attaching a shelf to each of the support arms 13; and (5) suitable hardware 18 for attaching the main bracket bar 11 to a vertical support surface, such as a wall. Accordingly, the different components of the bracket assembly can be made of various types of materials such as metals, polymers, composites, woods, and/or the like, and/or any combination thereof. Likewise, the shelf can be made of various types of materials such as metals, polymers, composites, woods, and/or the like, and/or any combination thereof. In still other embodiments, the bracket assembly 10 may utilize any other suitable fasteners (e.g., hardware) for at least temporarily coupling one or more components of the bracket assembly 10 to one another (e.g., for attaching each of the support arms 13 to the main bracket bar 11, for attaching the main bracket bar 11 to a vertical support surface, etc.).

As may be understood from FIGS. 1A and 1B, each support arm 13 is attached in various embodiments via the suitable hardware (e.g., one or more fasteners) to the main bracket bar 11, for example, by positioning the bolt 14 so that it extends through a horizontal elongated cutout 19 in the main bracket bar 11 that is disposed adjacent a respective end of the main bracket bar 11, placing the washer 16 and nut 15 on the distal end of the bolt 14 as shown, and tightening the nut 15. Accordingly, in various embodiments, the support arms 13 are designed to put weight onto the main bracket bar 11 while minimizing shear force on the hardware. Additionally, in particular embodiments, the shape of the support arms 13 is designed to direct at least a portion of the weight from the shelf back into the support surface. Further, in particular embodiments, the support arms 13 can be designed to be interchangeable. For example, the support arms 13 can be fully removed from the main bracket bar 11 and replaced with different shapes, designs, etc. Furthermore, in particular embodiments, the support arms 13 can be designed to be decorative.

As may be understood from FIGS. 1A, 1B, 2, and 3, each of the support arms 13 in particular embodiments includes a substantially U-shaped portion 20. In some embodiments, the U-shaped portion 20 is shaped to substantially conform to the shape of an indented length of the main bracket bar 11. Although the support arms 13 are shown to include substantially U-shaped portions 20, the support arms 13 can be designed to include other shapes. For example, the support arms 13 can be designed to include substantially straight portions, substantially V-shaped portions, substantially curved portions, and/or the like.

Figure 2:
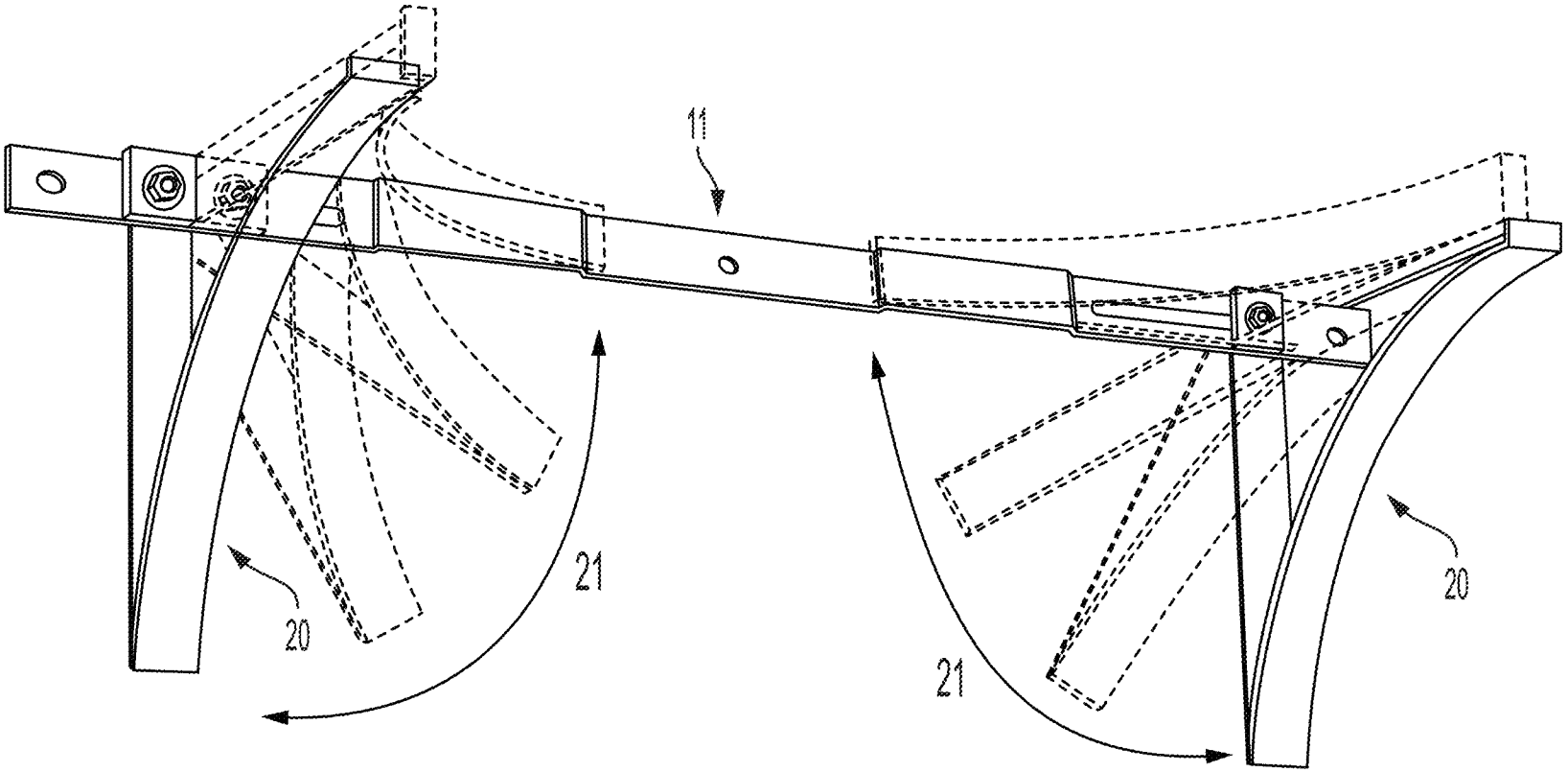
FIG. 2 is a diagram illustrating an example of a bracket assembly demonstrating movement of the support arms of the assembly according to various embodiments of the present disclosure.
Figure 3:
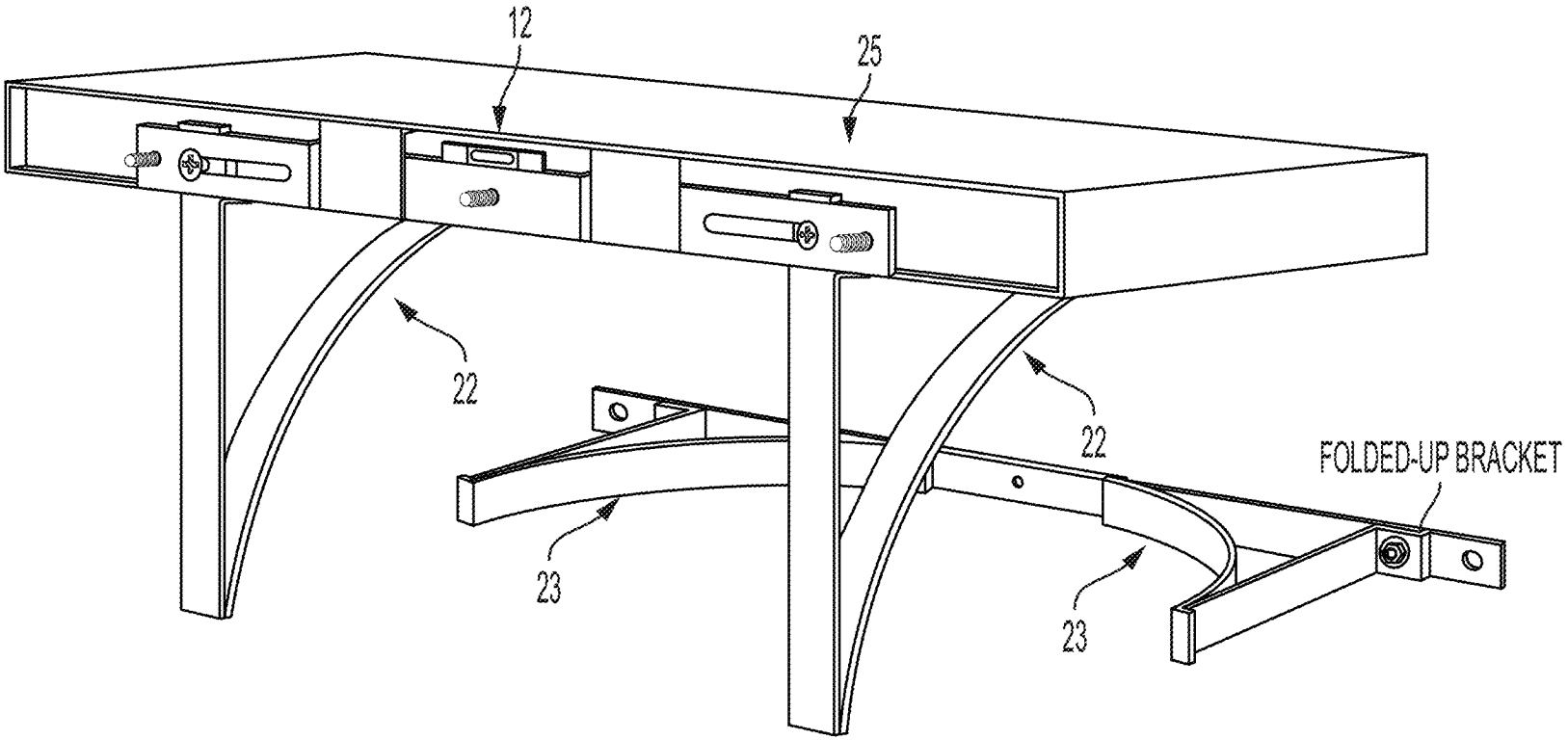
FIG. 3 is a diagram illustrating an example of a bracket assembly in a folded position according to various embodiments of the present disclosure.

As shown in FIG. 2, each support arm 13 can be configured so that when its respective hardware is disengaged (e.g., the nut 15 is loosened), the support arm 13 can be rotated 21 between a shelf support position 22 and a folded storage position 23, as shown in FIG. 3. As may be understood from FIG. 2 and FIG. 3, a thickness of each U-shaped portion 20 and support arm 13 is substantially the same as the thickness of the main bracket bar 11. In this way, when the support arms 13 are each in the folded storage position 23, the bracket assembly 10 in various embodiments is substantially flat, which can allow the bracket assembly 10, shelf, and hardware to be packaged within a relatively thin, long container (e.g., box) such as, for example, a container substantially in the shape of a rectangular prism. Such packaging can be advantageous for shipping and storage purposes.

Figure 4B:
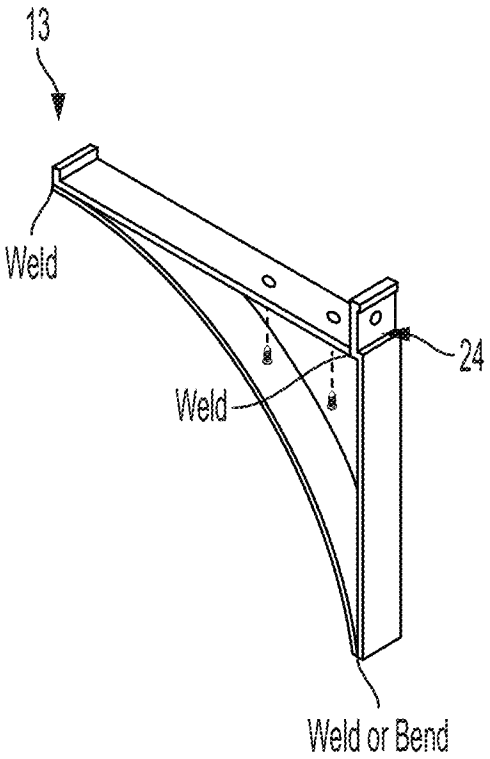
FIG. 4B is a diagram illustrating an example of a perspective view of a main bracket bar of a bracket assembly according to various embodiments of the present disclosure.
Figure 4A:
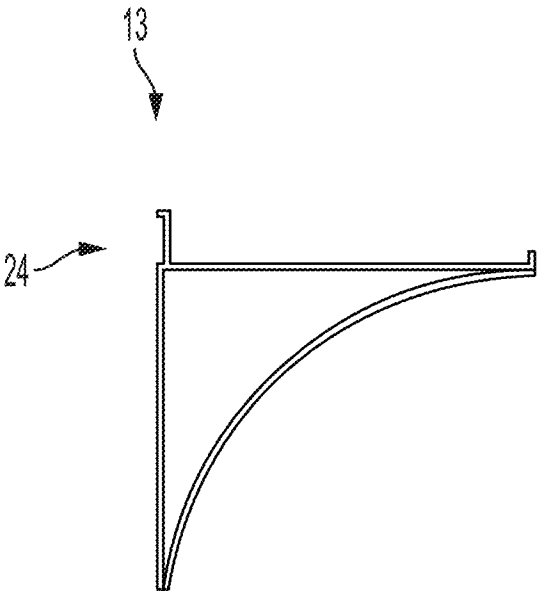
FIG. 4A is a diagram illustrating an example of a side view of a main bracket bar of a bracket assembly according to various embodiments of the present disclosure.

As can be understood from FIGS. 1A and 1B, the main bracket bar 11 can include elongated cutouts 19 in various embodiments to allow a user to easily adjust the spacing between the two support arms 13 by disengaging the respective hardware such as, for example, loosening one or more of the respective nuts 15, and sliding one or more of the respective support arms 13 laterally closer to or farther away from the other support arm 13. In addition, as shown in FIGS. 4A and 4B, each respective support arm 13 can have a U-shaped recess 24 at one end of the respective support arm 13 to maintain the support arm 13 in a substantially perpendicular orientation relative to the main bracket bar 11 when the respective hardware is engaging (e.g., when the nut 15 is tightened) one or more outside surfaces (e.g., opposing surfaces) of the main bracket bar 11. In addition, as shown in FIG. 1A, the level 12 can be positioned on an upper surface (or other surface) of the main bracket bar 11 to allow the user to easily install the main bracket bar 11 in a substantially level orientation. As shown in FIG. 3, in particular embodiments, the level 12 can be positioned so that it is behind the shelf 25, and therefore hidden from view, when the shelf 25 is installed on the support arms 13 and the bracket assembly 10 is attached to a support surface such as a wall.

Figure 5C:
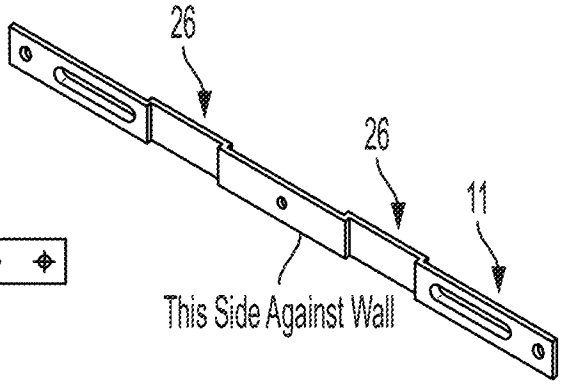
FIG. 5C is a diagram illustrating an example of a perspective view of a support arm of a bracket assembly according to various embodiments of the present disclosure.
Figure 5A:
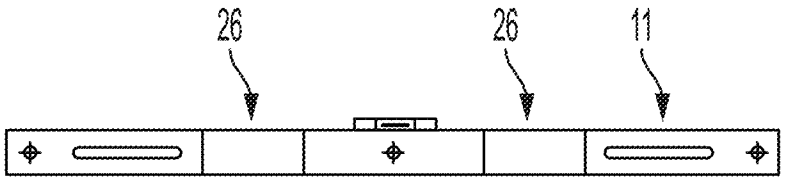
FIG. 5A is a diagram illustrating an example of a front view of a support arm of a bracket assembly according to various embodiments of the present disclosure.
Figure 5B:
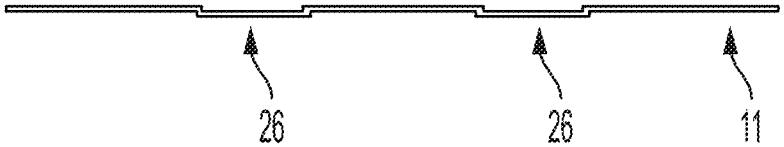
FIG. 5B is a diagram illustrating an example of a top view of a support arm of a bracket assembly according to various embodiments of the present disclosure.
Figure 6B:
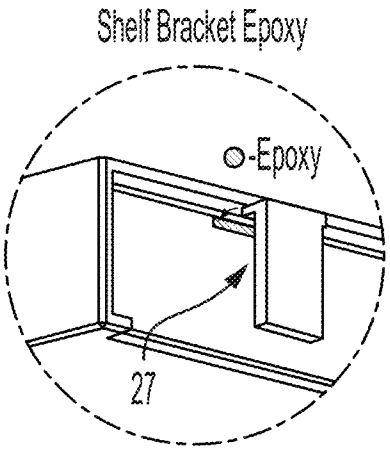
FIG. 6B is a diagram illustrating a detail view of the shelf shown in FIG. 6A.
Figure 6A:
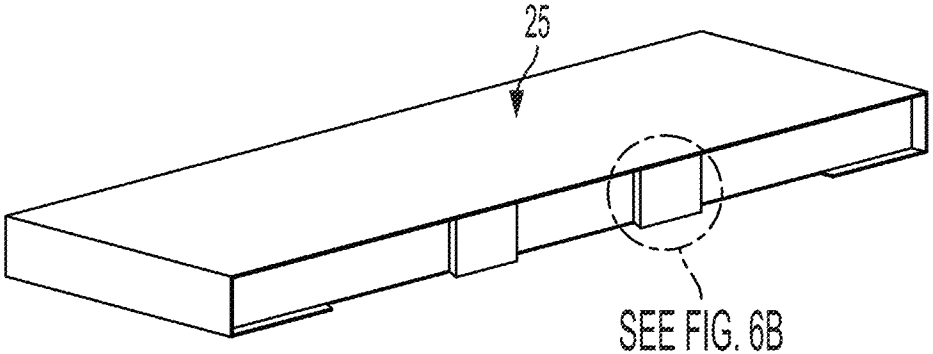
FIG. 6A is a diagram illustrating an example of shelf according to various embodiments of the present disclosure.

As may be understood from FIGS. 5A, 5B, 5C, 6A and 6B, the main bracket bar 11 and shelf 25 in various embodiments can be configured to allow the shelf 25 to be attached to the main bracket bar 11 without the use of hardware (e.g., screws). As shown in FIGS. 5A, 5B, and 5C, the main bracket bar 11 can include one or more recesses 26 along the length of the main bracket bar 11 that are configured for receiving slides-ins. Accordingly, as shown in FIGS. 6A and 6B, the shelf 25 can include the one or more slide-ins 27 that are made, for example, of metal, plastic, composite, or any other rigid material, that can slide into the recesses 26 of the main bracket bar 11 to attach the shelf 25 to the main bracket bar 11 without hardware. In some embodiments, the shelf 25 may be further attached to the main bracket bar 11 using some type of hardware such as one or more screws, nails, bolts, and/or the like. In addition, as shown in FIG. 1B, suitable hardware 17 can be used for attaching the shelf 25 to each of the support arms 13.

In various embodiments, the shelf 25 can vary in size and shape. For example, the shelf 25 can be in the shape of a square, a rectangle, a circle, an oval, and/or the like. Accordingly, the bracket assembly 10 may comprise various number of support arms 13 as may be required to accommodate different sizes and/or shapes of the shelf 25. In addition, the bracket assembly 10 may comprise support arms 13 having varying lengths to accommodate different sizes and/or shapes of the shelf 25. Likewise, the main bracket bar 11 can vary in length to accommodate different sizes and/or shapes of the shelf 25. Furthermore, the interchangeability of the support arms 13 can allow the support arms to be changed to accommodate different sizes and/or shapes of the shelf 25.

According to various embodiments, the shelf and bracket system is designed to provide maximum support to a shelf hanging on a support surface. In some embodiments, the support arms 13 can come attached to the main bracket bar 11, but not fully engaged (e.g., tightened) to the main bracket bar 11 to make assembly easier. For example, the bracket assembly 10 for the shelf and bracket system can be provided with the support arms initially in a folded storage position 23, as demonstrated in FIG. 3. Therefore, the process for assembling the shelf and bracket system can involve a user initially rotating the support arms 13 from the folded storage position 23, as demonstrated in FIG. 2, to a shelf support position 22, as demonstrated in FIG. 3. Once the support arms 13 have been rotated into the shelf support position 22, the process for assembling the shelf and bracket system can continue with the user engaging the support arms 13 to the main bracket bar using suitable hardware such as, for example, a bolt 14, nut 15, and washer 16. In addition, the process can involve the user laterally sliding one or both of the support arms closer to or farther apart within the elongated cutouts 19 provided in the main bracket bar 11 to adjust the spacing between the two support arms 13. Once the support arms 13 have been put into the correct position to support the shelf 25, the process can continue with the user engaging the hardware (e.g., tightening the nut 15) for each of the support arms 13 so that the support arm 13 does not move.

The process for assembling the shelf and bracket system can continue with the user using the integrated level 12 to find a level position on the support surface (e.g., the wall). In some instances, the user may find a level position on the support surface where the bracket holes for the bracket assembly 10 line up with at least one support associated with the support surface such as, for example, at least one wall stud found within a wall. In some instances, the user may in addition, or instead, use some type of anchor such as, for example, a dry wall anchor for mounting the bracket assembly 10 to the support surface. For example, the user may mark the locations of the bracket holes (e.g., with a pencil) on the support surface and if one or more of the hole locations does not line up with a support associated with the support surface, then the user may use an anchor for the one or more hole locations.

The user can then continue the process by securing the bracket assembly 10 to the support surface by engaging hardware through the bracket holes and into the support surface and corresponding supports and/or anchors. For example, the user can drill screws through the bracket holes into the support surface and corresponding supports and/or anchors. Once the bracket assembly 10 has been secured to the support surface, the process can involve the user aligning the slide-ins 27 provided on the shelf 25 with the corresponding recesses 26 in the main bracket bar 11 and gently pressing down on the shelf 25 to lock the shelf 25 into place on the bracket assembly 10. The user can then complete the process for assembling the shelf and bracket system by engaging some type of hardware from underneath the support arms 13 into the shelf 25. For example, the user can install set screws from underneath the support arms 13 into the shelf 25.

One of ordinary skill in the art will recognize that the described examples are not limited to any particular size. Further, one of ordinary skill in the art will recognize that shelf 25 and bracket assembly 10 are not limited to any type of material. One of ordinary skilled in the art will recognize that a number of designs, types, and/or thicknesses of materials can be utilized when taking into consideration aesthetic, safety, and stability consideration. A number of manufacturing techniques can be used in manufacturing the shelf and bracket system.

It will be appreciated by one of ordinary skilled in the art that changes can be made to the embodiments described herein without departing from the broad inventive concept thereof. It is understood, therefore, that the disclosure provided herein is not limited to the particular embodiments described, and is intended to cover modifications within the spirit and scope of the present disclosure. Several alternative embodiments and examples have been described and illustrated herein. One of ordinary skill in the art can appreciate the features of the individual embodiments, and the possible combinations and variations of the components. One of ordinary skill in the art can further appreciate that any of the embodiments could be provided in any combination with the other embodiments disclosed herein.

What is claimed is:

1. A shelf and bracket system comprising:
a shelf; and
a bracket assembly that comprises:
a main bracket bar,
a plurality of support arms, each of the plurality of support arms comprising:
a shelf support portion that extends perpendicularly outward from the main bracket bar and a vertical support surface when each of the plurality of support arms are coupled to the main bracket bar and the main bracket bar is coupled to the vertical support surface; and
a vertical support portion that extends perpendicular from the shelf support portion such that each of the plurality of support arms is substantially L-shaped,
first hardware for attaching each of the plurality of support arms to the main bracket bar,
second hardware for attaching the shelf to each of the plurality of support arms, and
third hardware for attaching the main bracket bar to the vertical support surface, wherein each support arm is disposed adjacent a respective end of the main bracket bar and the respective first hardware for the support arm is configured such that, when disengaged, the support arm is configured to rotate between a shelf support position in which the vertical support portion extends perpendicularly downward from the main bracket bar and a folded storage position in which the vertical support portion is parallel to the main bracket bar so that when each of the plurality of support arms are in the folded storage position, the bracket assembly is substantially flat.

2. The shelf and bracket system of claim 1, wherein each of the plurality of support arms is configured to direct at least a portion of a weight of the shelf into the vertical support surface when the plurality of support arms are in the shelf support position.

3. The shelf and bracket system of claim 1, wherein each of the plurality of support arms is configured to put weight onto the main bracket bar while minimizing shear force on the first hardware when the plurality of support arms are in the shelf support position.

4. The shelf and bracket system of claim 1, wherein each of the plurality of support arms comprises a substantially U-shaped portion that conforms to a shape of an indented length of the main bracket bar.

5. The shelf and bracket system of claim 1, wherein the main bracket bar comprises an elongated cutout for each of the plurality of support arms to allow for an adjustment of spacing between the plurality of support arms by sliding a respective support arm laterally closer or farther away from at least one other of the plurality of support arms.

6. The shelf and bracket system of claim 1, wherein each of the plurality of support arms comprises a recess at the respective end of the support arm to maintain the support arm in a substantially perpendicular orientation relative to the main bracket bar when the first hardware is engaged with one or more outside surfaces of the main bracket bar to attach the support arm to the main bracket bar.

7. The shelf and bracket system of claim 1, wherein the bracket assembly comprises a level positioned on an upper surface of the main bracket bar to allow for installation of the main bracket bar in a substantially level orientation.

8. The shelf and bracket system of claim 7, wherein the level is positioned on the upper surface of the main bracket bar so that the level is hidden from view when the shelf is installed on the plurality of support arms and the bracket assembly is attached to the vertical support surface.

9. The shelf and bracket system of claim 1, wherein the main bracket bar comprises one or more recesses along a length of the main bracket bar, and the shelf comprises one or more slide-ins configured for sliding into the one or more recesses to attach the shelf to the main bracket bar when the plurality of support arms are supporting the shelf in the shelf support position.

10. The shelf and bracket system of claim 1, wherein the plurality of support arms are interchangeable to accommodate at least one of different sizes or different shapes of the shelf.

11. The shelf and bracket system of claim 1, wherein the plurality of support arms are sized to accommodate at least one of different sizes or different shapes of the shelf.

12. The shelf and bracket system of claim 1, wherein the main bracket bar are sized to accommodate at least one of different sizes or different shapes of the shelf.

13. The shelf and bracket system of claim 1, wherein a height of the main bracket bar corresponds to a width of each of the plurality of support arms.

14. A shelf and bracket system comprising:
a shelf; and
a bracket assembly that comprises:
a main bracket bar,
a plurality of support arms, each of the plurality of support arms comprising:
a first portion configured to support the shelf on a vertical surface; and
a second portion that extends perpendicularly from the first portion and is configured to rest against the vertical surface when the first portion is supporting the shelf on the vertical surface such that the first portion and the second portion form an L-shape; and hardware for attaching each of the plurality of support arms to the main bracket bar, wherein each support arm is disposed adjacent a respective end of the main bracket bar and the respective hardware for the support arm is configured such that, when disengaged, the support arm is configured to rotate between a shelf support position in which the second portion is perpendicular to the main bracket bar and a folded storage position in which the second portion is parallel to the main bracket bar so that when each of the plurality of support arms are in the folded storage position, the bracket assembly is substantially flat.

15. The shelf and bracket system of claim 14, wherein each of the plurality of support arms comprises a substantially U-shaped portion that conforms to a shape of an indented length of the main bracket bar.

16. The shelf and bracket system of claim 14, wherein the main bracket bar comprises an elongated cutout for each of the plurality of support arms to allow for an adjustment of spacing between the plurality of support arms by sliding a respective support arm laterally closer or farther away from at least one other of the plurality of support arms.

17. The shelf and bracket system of claim 14, wherein each of the plurality of support arms comprises a recess at the respective end of the support arm to maintain the support arm in a substantially perpendicular orientation relative to the main bracket bar when the hardware is engaged with one or more outside surfaces of the main bracket bar to attach the support arm to the main bracket bar.

18. The shelf and bracket system of claim 14, wherein the main bracket bar comprises one or more recesses along a length of the main bracket bar, and the shelf comprises one or more slide-ins configured for sliding into the one or more recesses to attach the shelf to the main bracket bar without use of hardware.

19. The shelf and bracket system of claim 14, wherein the plurality of support arms are interchangeable to accommodate at least one of different sizes or different shapes of the shelf.

20. The shelf and bracket system of claim 14, wherein:

the plurality of support arms comprise a first support arm disposed adjacent a first end of the main bracket bar and a second support arm spaced apart from the first support arm on the main bracket bar disposed adjacent a second end of the main bracket bar, wherein the first support arm is rotatably attached to the main bracket via first hardware, and the second support arm is rotatably attached to the main bracket bar via second hardware;

the first support arm is configured to rotate counterclockwise about the first hardware from the shelf support position to the folded storage position; and the second support arm is configured to rotate clockwise about the second hardware from the shelf support portion to the folded storage position.

* * * * *